United States Patent [19]

Greenwell et al.

[11] 4,093,207

[45] June 6, 1978

[54] MAGAZINE AND FEEDER FOR CARTON BLANKS

[75] Inventors: Joseph Daniel Greenwell, Florence; Charles C. Hughes; Robert W. Kinney, both of Ludlow, all of Ky.

[73] Assignee: R. A. Jones & Co. Inc., Covington, Ky.

[21] Appl. No.: 746,466

[22] Filed: Dec. 1, 1976

[51] Int. Cl.[2] ..... B65H 1/30; B65H 3/30

[52] U.S. Cl. ..... 271/3.1; 271/23; 271/100; 271/118; 271/166

[58] Field of Search ..... 271/3.1, 23, 21, 166, 271/134, 100, 101, 106, 99, 104, 119, 118, 136, 112, 120, 102

[56] References Cited

U.S. PATENT DOCUMENTS

| | | | |
|---|---|---|---|
| 1,572,439 | 2/1926 | LaBombard et al. | 271/118 |
| 2,817,517 | 12/1957 | Wittkuhns et al. | 271/23 |
| 3,093,371 | 6/1963 | Glaser et al. | 271/100 |
| 3,155,386 | 11/1964 | Burleigh | 271/100 X |
| 3,202,421 | 8/1965 | Ganz | 271/166 UX |
| 3,372,923 | 3/1968 | Watson et al. | 271/23 |
| 3,466,030 | 9/1969 | Swanson | 271/23 X |
| 3,486,749 | 12/1969 | Billings | 271/112 |
| 3,893,664 | 7/1975 | Thomsen | 271/100 |

FOREIGN PATENT DOCUMENTS

| | | | |
|---|---|---|---|
| 47-12,818 | 12/1972 | Japan | 271/23 |
| 396,048 | 1/1966 | Switzerland | 271/101 |

*Primary Examiner*—Bruce H. Stoner, Jr.
*Attorney, Agent, or Firm*—Wood, Herron & Evans

[57] ABSTRACT

A magazine and feeder for carton blanks. The magazine has two stages and a pair of independently-driven rollers located between the two stages, which rollers support the major portion of the stack of carton blanks. Below the lower stage is an ejector mechanism which has a suction cup for pulling blanks downwardly one at a time and cooperating pressure and feed rolls for driving each blank individually out of the magazine. Assist rolls are also provided to assure proper alignment of the blanks as they are thrust out of the magazine. The lower stage includes a detector finger which is operatively connected to the independent drives for the rollers to cause the rollers to rotate from time-to-time to drop carton blanks into the lower stage, thereby replenishing the supply as blanks are fed from the ejector mechanism into the magazine.

3 Claims, 9 Drawing Figures

MAGAZINE AND FEEDER FOR CARTON BLANKS

This invention relates to a magazine and feeder for carton blanks.

Magazines for carton blanks and feeders or ejecting mechanism associated with such magazines are old and well-known in the art. When reference is made to a carton blank, it is to be understood that the term embraces flat blanks, folded glued blanks or other relatively stiff but flexible single sheet elements. In general, the magazines have been vertically oriented to receive a stack of carton blanks. A suction cup at the bottom of the magazine is arranged to engage the lowermost carton blank and pull it down slightly from the stack. Horizontally reciprocable plates are provided for engaging the rear edge of a blank to thrust the blank forwardly into the nip of feed rollers at the front side of the magazine.

While the magazine and feeder generally of the type described above have worked satisfactorily, it has had the disadvantage of requiring constant operator attendance to keep the magazine continuously supplied with carton blanks. The problem has been that only a limited number of carton blanks could be loaded into the magazines at one time since an excess number of carton blanks in the magazine would add so much weight to the lowermost blank in the stack that the increased friction, due to the weight, would prevent proper ejection of the lowermost blank from the stack.

It has therefore been a primary objective of the invention to provide a carton blank magazine and feeder mechanism which does not have the limitations of prior art magazines in that, for all practical purposes, an almost unlimited number of blanks can be stacked in the magazine without adversely affecting the feeding capability of the feeding and ejector mechanism.

In accordance with the present invention, a two-stage magazine is provided. An upper stage has at its lower end a pair of spaced-apart feed rollers which are intermittently operated to feed blanks into a lower stage. An unlimited number of blanks are supported on the rollers and the rotation of the upper surface of the rollers toward each other causes one or more blanks to be bowed inwardly and dropped to the lower stage.

In the lower stage the stack of blanks is maintained at a low height as, for example, a maximum of about three inches, but the normal height of the stack in the lower stage is made variable to accommodate different size blanks as will be discussed below. Means for detecting the height of the blanks is provided, for example, a microswitch having a detector finger in the path of the blanks so that when the desired height is achieved, the drive for the rollers at the bottom of the upper section is interrupted, the drive being restarted each time the level of the blanks falls below the detector finger of the microswitch.

The general organization of the two-stage magazine is shown in U.S. Pat. No. 3,466,030 which is directed to apparatus for feeding signatures. In its disclosed form it is unsuitable for the carton blank feeding operation and the present invention is directed to a number of features by which the general type of two-stage magazine is adapted to be operable in the feeding of carton blanks.

One feature of the invention resides in the provision of an inclined upper stage for the magazine. The inclined upper stage provides greater access for loading blanks into the magazine. Further, the blanks, when placed in the inclined upper stage, are slightly shingled,, the slight shingling of the cartons with respect to one another tends to break each blank away from the adjacent blanks and enables the blanks to be fed in reliably, that is, without feeding double blanks.

Another feature of the invention resides in the manner in which the rollers are formed, oriented with respect to the magazine, and driven. Each roller is formed with a plurality of longitudinally-extending radially outwardly-projecting ribs preferably formed of a friction type material, such as neoprene. These ribbed surfaces, when driven toward each other and into engagement with the undersurface of the carton blanks, effect the inward bowing of the blanks and cause the blanks to pass below the rollers.

One of the rollers is higher than the other and is preferably spaced from the edge of the carton blank in such a way that one or more blanks will drop first from the higher roller into the lower section of the magazine. The net effect of this operation is that the edge of the blank which drops first into the lower section will be close to the edge of the lower section and does not have to be shoved across previously dropped blanks as the opposite edge is ejecting from the upper stage and drops into the lower stage. This feature is particularly important where the blanks are large and thin for it avoids an undue bowing and, hence, jamming of the blanks in the lower stage. Stated another way, it provides for the more reliable dropping of the blanks flat into the lower stage.

Another feature of the invention consists of the driving of the two rollers by independent motors connected by clutches to the ends of the rollers. This feature enables the rollers to be shifted relative to one another very easily, thus enabling the magazine to be easily changed to accommodate different blanks. If the rollers were driven in synchronization as by a chain drive passing over the bottom rollers, the changeover to accommodate different size blanks would be considerably more difficult.

A lack of synchronization between the two rollers could give rise to feeding problems except for the orientation and form of the rollers which has been described above for it is the orientation and form of the rollers which admits of the reliable dropping of the carton blanks from the upper stage to the lower stage regardless of the lack of synchronization in the rollers.

Another feature of the invention consists of the adjustable means for detecting the height of the stack in the lower stage of the magazine. The adjustable stack height detector further facilitates the changeover of the machine from one size carton to another. In this regard, it is desirable to have the first-to-drop edge of the carton blank fed from the two rollers engage the stack in the lower section as close as possible to the edge of the stack. If a change is made from large blanks to small blanks without adjusting the height of the stack, the smaller blanks would swing down to the bottom of the stack and strike the uppermost blank in the stack at a position remote from the edge of the stack, thereby giving rise to the possibility of buckling or jamming. However, by adjusting the stack height detector upwardly so as to increase the height of the stack, then the shorter blank swinging down will strike the uppermost blank in the stack close to the edge of the stack. The alternative would be to provide for the lowering of the rollers but, as will be seen from the detailed description of the apparatus, this would be a very difficult undertaking.

Another objective of the invention has been to provide an improved ejector or feeder for drawing the lowermost blank out from under the magazine to thrust it toward carton ejecting apparatus. This objective of the invention involves the introduction of several new features into the ejector to enable different types and sizes of blanks to be reliably fed outwardly and to avoid any twisting or skewing of the blank as it is thrust out from under the magazine.

A first feature involves a single suction cup draw down of the blank with provision for transverse adjustment of it and the feed rolls associated with it to enable it to be positioned opposite the "best" edge of the blank to be fed into the nip of the feed rolls.

A second feature involves the provision of an arcuate surface around which the blank is pulled by the suction cup coupled with providing for an arcuate movement of the suction cup so that when the blank is pulled down by the suction cups, there is no slippage of the cup with respect to the carton blank.

Still another feature of the invention involves the universal mounting of pressure rolls which cooperate with feed rolls, the universal mounting for the pressure rolls accommodating any out of round condition of the feed roll and thereby applying a uniform pressure to the blank as it is drawn out from under the stack.

Yet another feature of the ejector mechanism involves the provision of thrust rolls spaced transversely across the bottom of the magazine, the thrust rolls having surfaces adapted to engage the ejecting blank to maintain the blank in longitudinal alignment as it is ejected so that the blank moves out straight into the ejecting apparatus.

The several features and objectives referred to above will become more readily apparent from the following detailed description taken in conjunction with the drawings in which.

In the context of this description, the term "front" will refer to the downstream side of the mechanism that is the side from which the carton blanks are finally ejected, and "rear" will refer to the upstream side of the mechanism.

Figure 1:
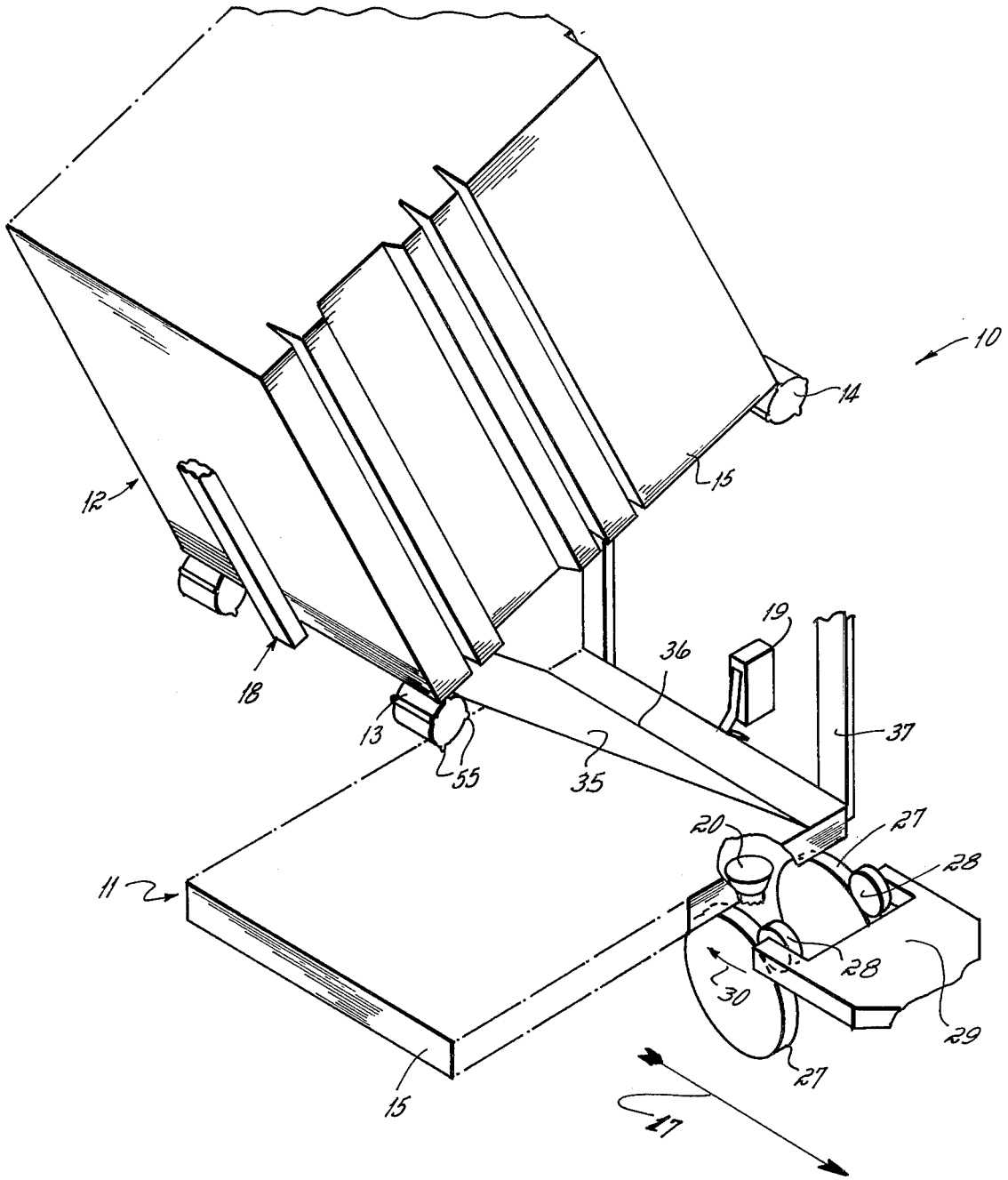
FIG. 1 is a diagrammatic perspective view of the apparatus of the invention.
Figure 2:
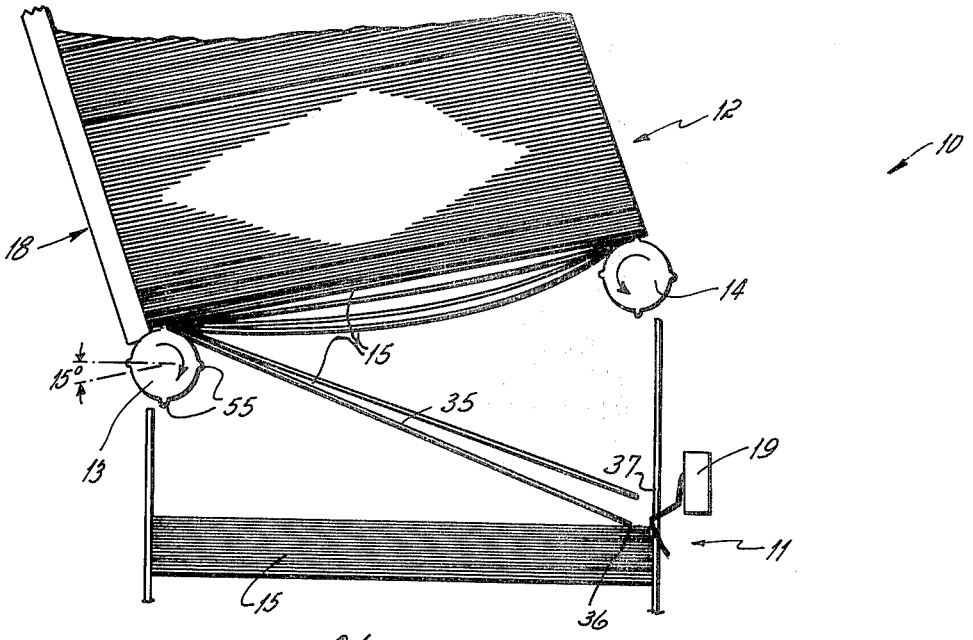
FIG. 2 is a diagrammatic elevational view of the magazine in accordance with the present invention.

Referring to FIGS. 1 and 2, the magazine of the present invention is indicated at 10 and includes a lower stage 11 and an upper stage 12. A pair of feed rollers 13 and 14 are located between the upper and lower stages and provide support for a stack of carton blanks 15 which have been placed in the upper magazine stage and rest upon the rollers. The upper stage has a side wall 18 which is inclined at about 30° to vertical. The roller 13 is lower than the roller 14, the axes of the rollers 13 and 14 being parallel and defining a plane which lies at about 15° to horizontal. Thus, the angle between the axes of the rollers and the side wall 18 of the upper stage is about 105°. As shown in FIG. 2, the angular relationship described above causes the carton blanks, when stacked in the upper stage, to shingle slightly as their edges are forced against the magazine side wall 18. This shingling helps to break the individual carton blanks away from one another so that they will be more easily fed out of the magazine.

A stack height detector 19 is mounted for vertical adjustment on the lower stage of the magazine to detect the height of the stack and is connected to the clutches for the drive motors for the rollers 13 and 14 to cause them to rotate when the stack is below a predetermined height. The detector 19 is connected to the motor clutches through a time delay to provide for the operation of the rollers only when the stack is high enough to operate the detector for at least a short interval, thereby avoiding repeated operation of the rollers each time a blank falls.

Immediately below the magazine is the ejector mechanism which is illustrated diagrammatically in FIG. 3. The function of the ejector mechanism is to eject from the bottom of the magazine carton blanks, one-by-one, and feed them straight out of the magazine in a direction 17 parallel to the rollers 13 and 14 as viewed in FIG. 1. The ejector mechanism includes a single suction cup 20 which is mounted on a spring steel support 21, the spring steel support being cantilevered from an arcuate surface 22. A mechanism, described below, is operable to reciprocate the suction cup which, since it is mounted on the spring steel element 21, moves in an arcuate path whose center is indicated at 23 and is approximately the tangent of the intersection of a flat blank with the arcuate surface 22. Thus, as the suction cup moves downwardly, carrying with it a carton blank which it has previously engaged, the blank 15 which is pulled down by the suction cup follows the same path as the suction cup so that there is no slippage between the two.

At the lower edge of the magazine the front wall has a serrated portion 25 against which the edges of the blanks rest, the serrated portion resisting downward movement of the blanks, thereby minimizing the possibility that the suction cup would pull down more than one blank.

Immediately adjacent the suction cup are a pair of eject rolls 27, one on each side of the suction cup. The eject rolls are of a molded friction type material, such as neoprene, adapted to engage the surface of the blanks to drive them out. A pair of pressure rolls 28 are maintained on arms 29 and are adapted to swing into overlying, pressure-applying relation to the pressure rolls 28. Thus, when a carton blank is pulled down onto the eject rolls 27, the pressure rolls are swung in the direction of the arrow 30 to clamp the blank 15 against the eject rolls which then thrust the blank out from under the magazine.

Figure 3:
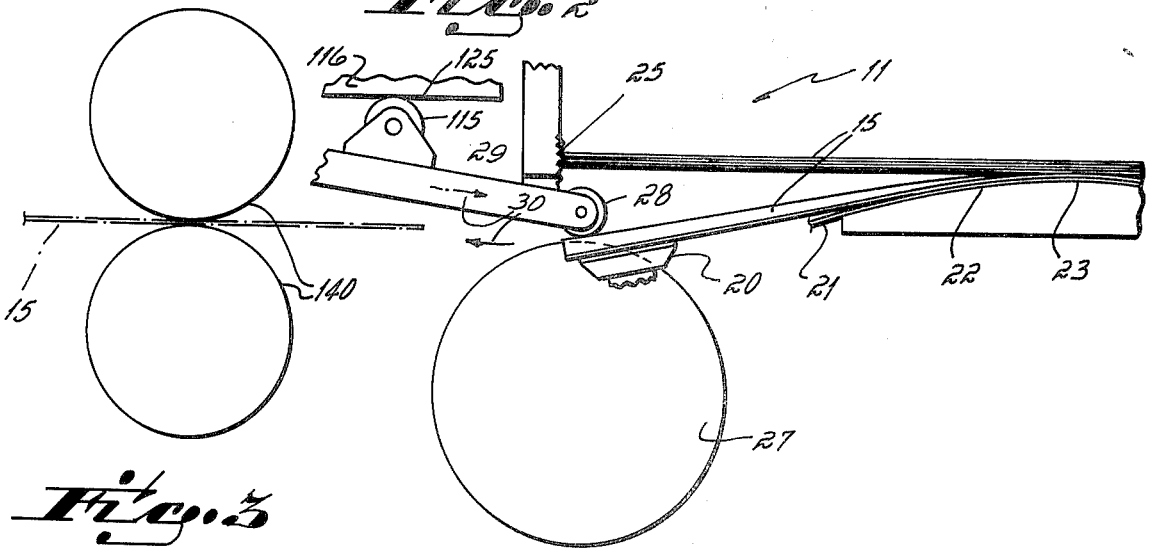
FIG. 3 is a diagrammatic elevational view of the feeder mechanism located at the bottom of the magazine.
Figure 9:
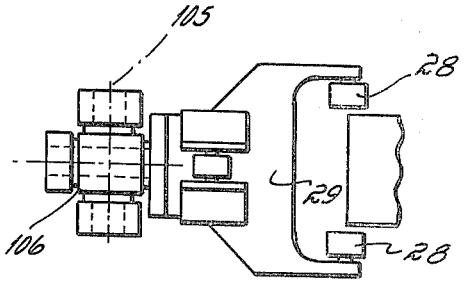
FIG. 9 is a view taken along line 9—9 of FIG. 8.

The operation can be generally understood by reference to FIGS. 1-3. Carton blanks are loaded into the upper stage 12 of the magazine. Initially the operator might put a prime group of blanks from the upper stage into the lower stage until the level of the blanks is at approximately the right height. Operation of the machine is begun and blanks are continuously ejected from the bottom of the lower stage. As the supply of blanks in the lower stage of the magazine is depleted, the height detector 19 will be caused to operate which in turn effects the energization of motors which drive the feed rollers 13 and 14. The roller 13 rotates in a clockwise direction and the roller 14 in a counterclockwise direction so that their upper surfaces rotate toward each other causing the blanks to bow inwardly. Preferably, the higher roller 14 is adjusted laterally with respect to the edge of the carton blanks 15 so that the higher edges of the carton blanks will drop down into the lower stage ahead of the lower edges of the carton blank. Thus, each carton blank, or a group of two or three or more, will initially fall to the attitude indicated at 35 in FIG. 2 where a free edge 36 of each blank is spaced from the side 37 of the lower stage. Immediately thereafter continued rotation of the roller 13 will cause the edge resting on it to be thrust off the roller and down into the lower stage while simultaneously sliding the edge 36 of the blank along the top of the stack in the lower stage.

It will be observed that in order for the blank edge 36 to be shoved across the top of the stack in the lower stage, the blank must be stiff enough for the thrust on its upper edge to be transmitted through the stack to the lower edge 36. This stiffness is found in approximately 20 point and thicker paperboard.

With some difficult to handle carton blanks it is very important to minimize, as far as possible, the distance between edge 36 and the side wall 37 of the lower stage and to maintain as acute an angle as possible between the dropping blank and the stack below so that the blank, when being driven off the roller 13, will not buckle and jam the operation. For this reason the stack height detector is made vertically adjustable, thereby permitting the stack height to be raised for shorter blanks and lowered for longer blanks.

In the feeding of the carton blanks the suction cup 20 is raised into engagement with the lowermost carton blank 15 in the stack and vacuum is applied. After vacuum is applied the suction cup is lowered to pull the blank down against the eject rolls 27. While the blank is held against the eject rolls 27, the pressure rolls are moved toward the right as viewed in FIG. 3 to clamp the leading edge of the blank against the eject rolls. The rotation of the eject rolls drives the blank out from under the magazine and into the creasing and folding and gluing apparatus downstream of the magazine, that apparatus being shown in copending application Ser. No. 690,644, filed May 27, 1976, now U.S. Pat. No. 4,056,046.

Figure 4:
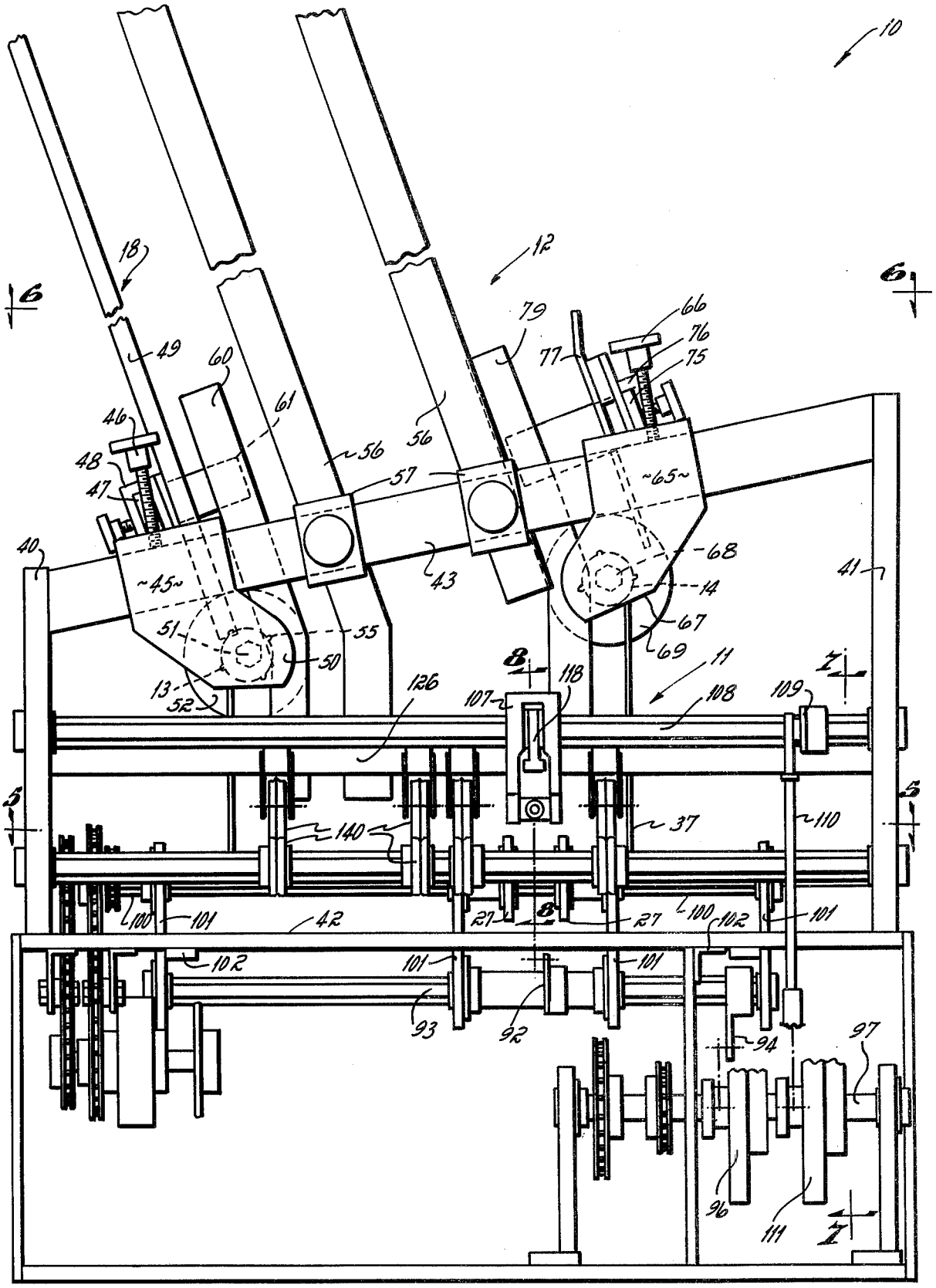
FIG. 4 is a side elevational view of the magazine of the present invention.
Figure 5:
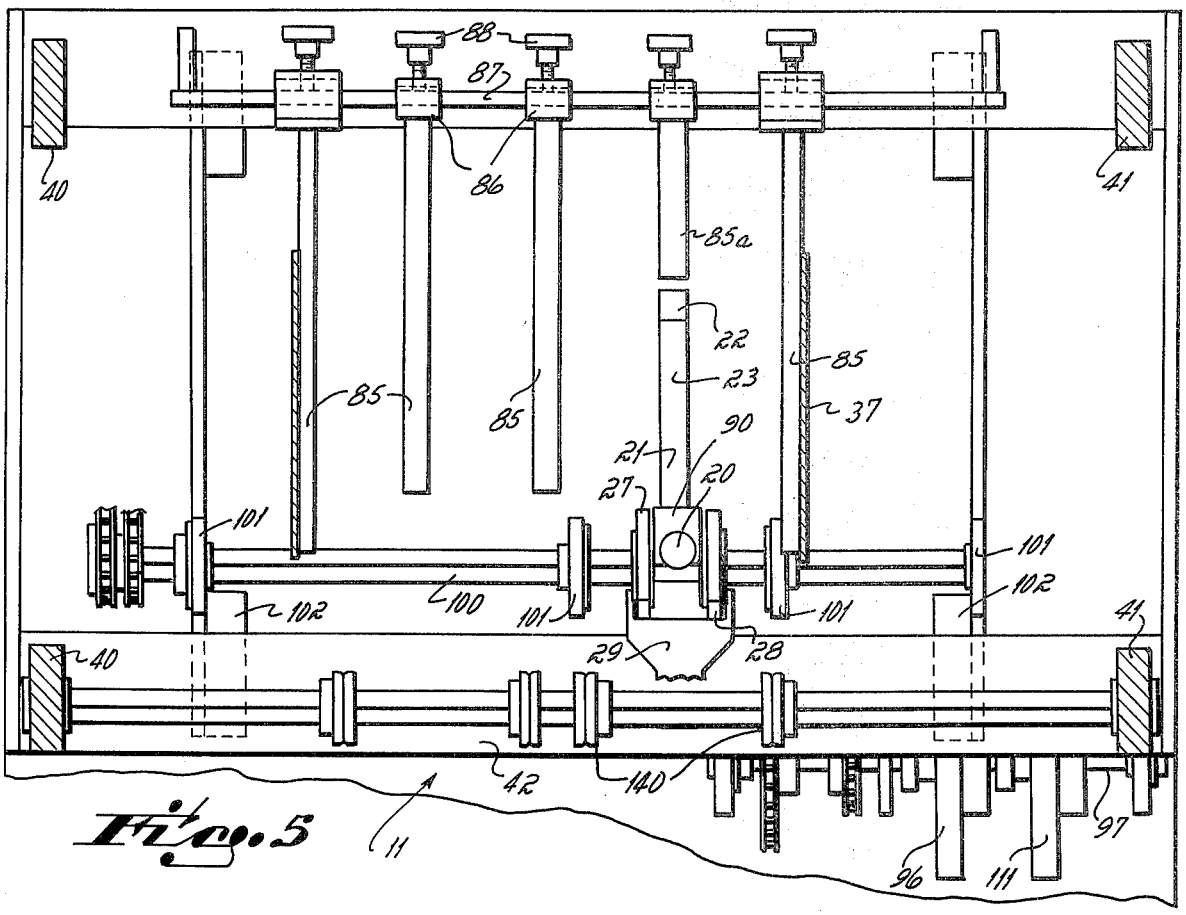
FIG. 5 is a cross-sectional view taken along line 5—5 of FIG. 4.
Figure 6:
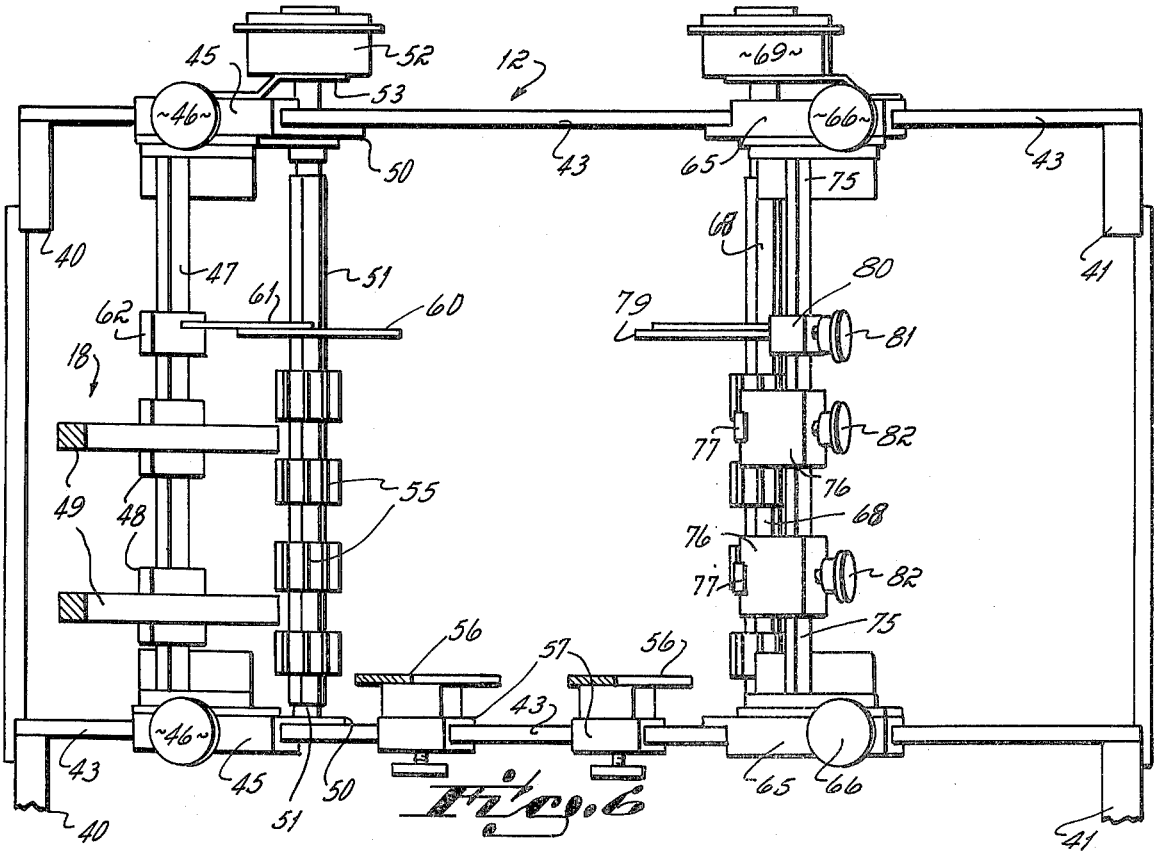
FIG. 6 is a cross-sectional view taken along line 6—6 of FIG. 4.

The details of the magazine structure are shown in FIGS. 4–6. It will be seen from the following description that the magazine is adapted to accommodate blanks of varying sizes. The lower stage 11 of the magazine is formed in part by two short vertical posts 40 and two longer vertical posts 41 on the opposite side which are mounted on a rigid base 42. A pair of cross bars 43 are fixed to and extend between the posts 40 and 41 to provide support for the upper magazine state 12 and for the rollers 13, 14.

At the left side of the magazine slidable blocks 45 are mounted on the cross bars 43 (FIGS. 4 and 6) and are adapted to be fixed in a selected position on the bars 43 by hand-operated set screws 46. The blocks 45 carry between them a bar 47 (FIG. 6) on which adjustable blocks 48 are slidably mounted. The blocks 48 have hand-operated set screws to fix them in position on bar 47. The adjustable blocks carry posts 49 which form the inclined side wall 18 of the magazine against which the carton blanks rest.

The blocks 45 also carry depending brackets 50 in which a hexagonal shaft 51 is journalled (FIGS. 4 and 6). A motor 52 is in driving engagement through an electrically energized clutch to the shaft 51 and is fixed to one of the blocks 45 by a bracket 53. The rollers 13 are mounted on the shaft 51, the rollers 13 being slidable with respect to the shaft, but nonrotatably fixed to the shaft. Each roller (FIG. 4) has a plurality of axially extending friction ribs 55 secured to the surface of the rolls and projecting therefrom. The ribs serve to engage the surface of the carton blanks and without tearing the surface (as would occur with pins or the like) cause the cartons to bow inwardly as they are being dropped from the upper stage to the lower stage.

The upper stage of the magazine has a tall front wall formed by two posts 56 which carry a suitable bracing at the top, not shown. The posts 56 are connected by slidable blocks 57 mounted on the cross bar 43 at the front side of the magazine.

At the rear of the upper stage is a short wall formed in part by a short post 60 which is secured to a bracket 61 fixed to a block 62, the block 62 being slidable on the bar 47. The block 62 is slidable on the bar 47 so as to adjust the magazine for varying sizes of blanks, and has a hand-operated set screw for fixing it in its adjusted position. In adjusting for various sizes of blanks, the front wall defined by the posts 56 remains fixed so as to maintain a fixed position of the leading edge of the carton blank with respect to the ejector mechanism.

At the righthand side of the magazine, as viewed in FIGS. 4, 5 and 6, a pair of blocks 65 are slidably mounted on the front and rear bars 43 and are adapted to be fixed in a selected position by hand-operated set screws 66. As best shown in FIG. 4, each block carries a depending bracket 67 into which a hexagonal shaft 68 is journalled. The shaft 68 carries axially slidable and rotatably fixed rollers 14 which also have friction ribs identical to those described in connection with the rollers 13.

A motor 69 is drivably connected through an electrically energized clutch to the shaft 68 and is fixed to the block 65 at the rear of the magazine. A bar 75 extends across the magazine and is fixed to the respective blocks 65. The bar carries two adjustable blocks 76 from which side guides 77 project upwardly. The upper end of each side guide is flared slightly outwardly to funnel the blanks into position against the rollers 13, 14.

The detector 19 is of course connected to the clutch for the respective motors 52 and 69 to cause their operation as described.

A short rear wall post 79 projects upwardly from a block 80 which is also slidable on the bar 75 and adapted to be fixed in a selected position by the hand-operated set screws 81. The blocks 76 are also provided with hand-operated set screws 82 enabling the blocks to be adjustably positioned along the bar 75.

The bottom of the lower stage of the magazine is defined by five parallel slats 85 (FIG. 5) which are cantilevered from blocks 86 which are slidable on a bar 87 fixed to the base 42. Hand-operated set screws 88 enable the slats to be adjustably positioned across the bar 87. The blocks 86 are also removable from the bar so as to enable the selective positioning of the short slat **85*a* at any position along the bottom of the lower stage. As will appear in greater detail below, the short slat 85*a*** is normally aligned with the arcuate surface 22 and spring 21. That surface along with the ejecting mechanism is adapted to be positioned at any desired location along the bottom of the lower stage so that it can overlie the preferred panel and flap of the particular carton blank. As seen in FIG. 1, because of the differing configuration of the flaps on differing carton blanks, not every portion of the leading edge of a carton blank is suitable for being drawn and thrust into the nip between the eject rolls and pressure rolls of the ejector mechanism. Therefore, for reliable ejecting apparatus the adjustment across the bottom of the lower stage is necessary.

Figure 7:
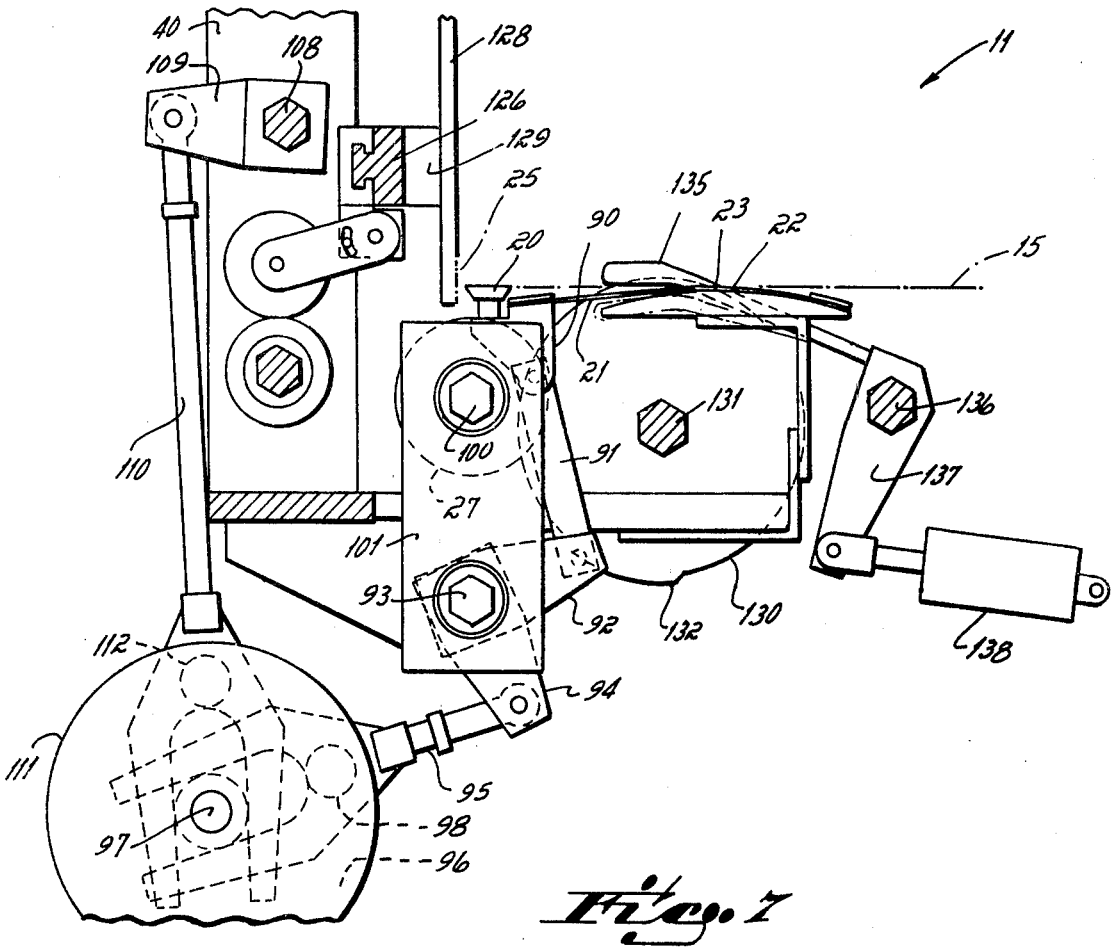
FIG. 7 is a cross-sectional view taken along line 7—7 of FIG. 4.
Figure 8:
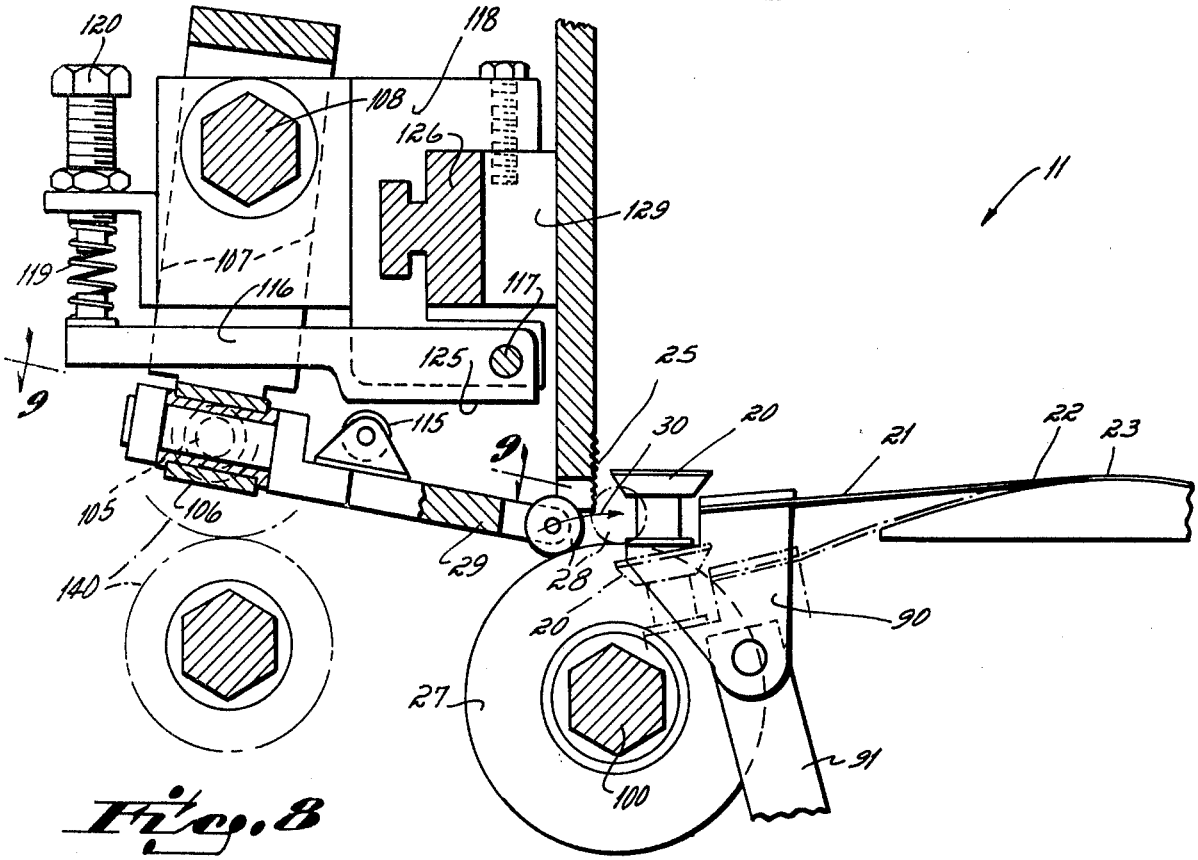
FIG. 8 is a cross-sectional view taken along line 8—8 of FIG. 4.

As described above, the suction cup 20 is mounted on spring 21. Referring to FIGS. 7 and 8, a lug 90 is fixed to the spring and carries the suction cup. The lug 90 is pivotally connected to a link 91, the other end of which is connected to an arm 92 which is fixed to shaft 93 (journalled in brackets 101 (FIG. 4)). Another arm 94 is fixed to the shaft 93 and is connected to a cam follower 95 which is associated with a cam 96 rotated by a shaft 97. The follower 95 has a roller 98 which rides in a track, not shown, in the cam 96 to effect the reciprocation of the suction cup 20. The oscillation of follower 95 as cam 96 rotates causes an oscillation of the shaft 93 which in turn oscillates the arm 92, causing the suction cup to move up and down. The suction cup is, of course, connected to a vacuum source in a conventional manner, the vacuum source being timed for repeated application to the suction cup by a cam-operated timer, also not shown.

The eject rolls 27 are continuously driven by a shaft 100 journalled in brackets 101 (FIGS. 4, 5 and 7) which are in turn secured by angle members 102 to the base 42. The two eject rolls 27 located on either side of the suction cup 20 cooperate with two pressure rolls 28 which are rotatably mounted on a bifurcated arm 29. The arm 29 is pivotally mounted as at 105 in a block 106. The block 106 is mounted on an arm 107 fixed to a shaft 108. An arm 109 is fixed to the shaft 108 and is connected to a follower 110 which cooperates with a cam 111. The follower has a roller 112 which rides in a track in the cam 111 and causes the oscillation of the follower 110. Oscillation of the follower 110 oscillates shaft 108 causing the arm 29 and pressure rolls 28 to move toward and away from the eject rolls 27.

The arm 29 carries a roller 115 which is engageable with an arm 116 pivoted at 117 to block 118. A compression spring 119, which is adjustable by bolt 120, is mounted between the free end of the arm 116 and the block 118. As the arm 29 is moved toward the eject rolls, the roller 115 engages a surface 125 on the arm 116 and compresses the spring 119 which in turn applies pressure on the pressure rolls 28 against the eject rolls 27.

Because the bifurcated arm 29 is able to pivot in block 106, the pressure rolls 28 are able to follow the contour of eject rolls 27, and apply uniform pressure to each even though they might be slightly out of round.

The block 118 is slidable on a T-shaped bar 126 which is mounted between the posts 40 and 41. A post 128 is mounted on block 129 which is in turn bolted to the block 118 and slides with it. The serrated surface 25 at the lower end of the post 128 defines the front end of the lower stage of the magazine and provides assurance that only one carton blank is drawn down at a time by the suction cup 20. The post 128 projects slightly into the space between the rollers 28 on the bifurcated arm 29 as shown in FIG. 8.

Assist rolls 130 (FIG. 7) are mounted on a shaft 131 and are adapted to engage the undersurface of each carton blank to assist in thrusting it out of the magazine. Each assist roll has a protuberance 132, the remaining surface of the roll lying slightly below the undersurface of the lowermost blank. The assist rolls 130, four being spaced across the bottom of the magazine, are continuously running with the movement of the protuberances in engagement with the carton blank being timed to coincide with the engagement of the blank with the nip between the eject rolls and pressure rolls. The combined action of the elements provides assurance that the carton blank will be ejected straight out of the magazine rather than skewed.

Referring to FIG. 7, four lift fingers 135 are mounted along the bottom of the magazine on a shaft 136. An arm 137 fixed to the shaft is connected to a pneumatic piston and cylinder 138 which is in turn connected to means for energizing it when a jam occurs downstream and it is desired to feed no more blanks. Energization of the piston and cylinder causes the lift fingers 135 to swing in a clockwise direction lifting the carton blanks above the level of the suction cup 20 and rollers and protuberances 132 on the assist rolls. Thus, while the lift fingers are in that operative position, all of the elements of the ejector mechanism can continue to run but since the carton blanks are held up out of the way of the operative elements, no carton blanks will be ejected.

Crease rolls 140 may be provided to crease the carton blanks as they are ejected from the magazine. Drive means are provided to drive all of the operating elements in synchronism (except the feed rollers 13, 14 which are independently driven in response to the height detector 19). These operating elements include the shaft 97 for the cams 96 and 111, shaft 100 for the feed rolls 27, and shaft 131 for the assist rolls 130.

In the operation of the invention the elements of the magazine are first adjusted to the size and configuration of the carton blanks to be fed from the magazine. The vertical elements of the magazine forming the walls of the upper stage of the magazine are adjusted using the hand-operated set screws as described above. The particular portion of the leading edge of a blank which is to be pressed through the eject rolls is selected and the transverse location of the ejector assembly is determined by sliding the ejector assembly, including the suction cup, the feed and press rolls and associated linkages, along the shafts 93, 100 and 108. When the ejector assembly is positioned, the short slat **85*a* is also positioned opposite the leaf spring 21 as shown in FIG. 5**.

The stack height detector 19 is also adjusted to the proper vertical position, the stack height being higher for smaller carton blanks.

After the adjustments are made, the operator places a prime of carton blanks in the lower stage of the mechanism and loads a stack of blanks in the upper stage as, for example, a five foot stack. In the loading of the blanks in the upper stage, the blanks rest solely upon the rollers 13 and 14 and are leaned against the inclined wall 18. In forcing the blanks against the inclined wall, each blank shingles slightly with respect to the adjacent blank, thereby loosening the blanks with respect to one another to assist in the proper feeding of one blank at a time through the ejector mechanism.

After the apparatus has been energized to begin its operation, the blanks are ejected as follows: the suction cup 20 is raised with vacuum applied to engage the undersurface of the lowermost blank. The suction cup is lowered to bend the blank and the leaf spring 21 about the arcuate surface 22. Since the blank and the suction cup move in the same arcuate path, there is no slippage between the blank and the suction cup. One blank at a time is pulled against the pressure rolls 27, the remaining blanks being blocked in their descent by the serrated or saw tooth surface 25 on the post 128.

Pressure rolls 28 are advanced into engagement with the upper surface of the carton. In advancing toward the eject rolls 27, the roller 115 rolls along a surface 125, thereby pressing the rolls 28 against the carton blanks and in turn pressing the carton blanks against the eject rolls 27. Since the eject rolls are continuously running, as soon as the pressure rolls press the carton blank against the eject rolls, the carton blank starts to eject from the magazine. At this time the vacuum on the suction cup is released so that the blank is free to advance. Also at this time the protuberance 132 on the rolls 130 moves upwardly into engagement with the carton blank and assists in moving it in a straight line out of the magazine. The straight line movement of the blank is also assisted by the uniform pressure applied by the pressure rolls, that uniform pressure being effected in part by the pivotal mounting of the arm 29 which supports the pressure rolls. If the feed rolls, which are molded elements, are slightly out of round, the pressure rolls are able to conform to the out of round configuration of the feed roll surface through a slight rotation of the arm in its pivotal mounting.

Carton blanks are rapidly ejected from the lower stage in the manner just described. If the height of the stack of cartons in the lower stage of the magazine falls below the desired level, the height detector 19 effects the energization of the clutches of the two motors 52 and 69 associated with the rollers 13 and 14, respectively, to cause them to rotate toward each other. As the rollers rotate, they will feed one or a plurality of blanks at a time into the lower stage. Preferably, the rolls have been adjusted with respect to the respective edges of the stack so that the righthand or higher edges of the blanks, as viewed in FIGS. 1 and 2, will drop from the rollers first to assume the attitude shown at 35. The continued rotation of the roller 13 will push the blank toward the right side of the lower stage and drop the lefthand edge of the blank into the lower stage.

As the stack height is increased, its level is once again detected by the height detector 19 and when its satisfactory level is achieved, the detector 19 will effect the deenergization and hence release of the clutches to the motors 52 and 69.

In the event of a jam or the like downstream of the magazine when it is therefore desired to discontinue the feeding of the blanks, the pneumatic piston and cylinder 138 is energized to secure lift fingers 135 up to and in engagement with the bottom of the carton blanks, thereby lifting the lowermost carton blank a sufficient distance to be free of engagements of the suction cup 20 and the protuberance 132 in the assist roll.

Because the ejector mechanism is required to work with a stack which is no higher than about 3 inches, it operates very reliably regardless of the size of the stack of blanks presented by the operator in the upper stage of the magazine.

The magazine and ejector mechanism has been shown as adapted for feeding blanks into a side seam gluer of the type disclosed in application Ser. No. 690,644, filed May 27, 1976, now U.S. Pat. No. 4,056,046. However, it should be understood that the magazine is suitable for feeding relatively stiff elements in an application such as preglued carton blanks, machine readable cards or other types of blanks where a relatively large supply must be stacked and fed to an ejector mechanism.

We claim:

1. In a carton blank feeding mechanism a magazine lower stage, a blank ejecting mechanism located below the lower stage, a magazine upper stage located immediately above the lower stage and being inclined to the vertical, and a pair of transversely spaced feed rollers located between the upper and lower stages, said rollers forming the sole support for carton blanks mounted in the upper stage of said magazine, the upper stage of the magazine having one wall which is at an angle of approximately 30° to the vertical, the axes of said rollers defining a plane lying at an angle of approximately 105° to said inclined wall, whereby cartons loaded in said upper stage and resting on said rollers will be shingled with respect to each other.

2. Apparatus for feeding carton blanks at least approximately 0.020 inch thick comprising, a magazine upper stage, a magazine lower stage located immediately below said upper stage, blank ejecting mechanism at the bottom of said lower stage, a pair of transversely spaced rollers located between said upper and lower stages, the axis of one of said rollers being higher than the axis of the other roller, said rollers forming the sole support for carton blanks mounted in the upper stage of said magazine, a plurality of friction ribs projecting radially outwardly from said rollers, said ribs being axially extending and circumferentially spaced about said feed rollers, means for simultaneously and intermittently rotating said rollers, said rollers being positioned with respect to the respective edges of the blanks so as to cause said motor to first drive one edge of at least one blank around the higher of said rollers and after said edge drops into said lower stage to drive the opposite edge of said blank around the lower of said rollers to slide said one edge across said lower stage and to permit said opposite edge and hence said complete blank to drop into the lower stage of said magazine, a stack height detector mounted on said lower stage and connected to said means for rotating said rollers to rotate said rollers when said stack falls below a preselected level.

3. Apparatus for feeding carton blanks at least approximately 0.020 inch thick comprising, a magazine upper stage, a magazine lower stage located immediately below said upper stage, blank ejecting mechanism at the bottom of said lower stage, a pair of opposed blocks at each side of said upper stage, means mounting said blocks on said upper stage for lateral adjustability, a pair of transversely spaced rollers located between said upper and lower stages and mounted on shafts carried by said blocks, said rollers forming the sole support for carton blanks mounted in the upper stage of said magazine, a plurality of friction ribs projecting radially outwardly from said rollers, said ribs being axially extending and circumferentially spaced about said feed rollers, a motor connected to each of said roller shafts, each motor being mounted on one of said blocks, means including said motors for intermittently rotating said rollers to first drive one edge of at least one blank around one of said rollers and after said edge drops into said lower stage to drive the opposite edge of said blank around said opposite roller to permit said opposite edge and hence said complete blank to drop into the lower stage of said magazine, a stack height detector mounted on said lower stage and connected to said means for rotating said rollers to rotate said rollers when said stack falls below a preselected level, said rollers being easily shiftable laterally by shifting said blocks to effect changeover to different sizes of carton blanks.

* * * * *